United States Patent [19]

McCubbin

[11] 4,071,072

[45] Jan. 31, 1978

[54] METHOD OF DIRECT CHILL CASTING OF ALUMINUM ALLOYS

[75] Inventor: John Gordon McCubbin, Kingston, Canada

[73] Assignee: Alcan Research and Development Limited, Montreal, Canada

[21] Appl. No.: 719,859

[22] Filed: Sept. 2, 1976

Related U.S. Application Data

[63] Continuation-in-part of Ser. No. 521,371, Nov. 6, 1974, abandoned.

[30] Foreign Application Priority Data

Nov. 6, 1973 United Kingdom ..... 51560/73

[51] Int. Cl.[2] ..... B22D 11/16

[52] U.S. Cl. ..... 164/89; 164/122; 164/8; 164/444

[58] Field of Search ..... 164/82, 89, 122, 123, 164/126–128, 281, 273 R, 283 R

[56] References Cited

U.S. PATENT DOCUMENTS

| | | | |
|---|---|---|---|
| 3,441,079 | 4/1969 | Bryson | 164/89 |
| 3,494,410 | 2/1970 | Birchill et al. | 164/281 X |
| 3,612,151 | 2/1969 | Harrington et al. | 164/89 |

*Primary Examiner*—Ronald J. Shore
*Assistant Examiner*—Gus T. Hampilos
*Attorney, Agent, or Firm*—Cooper, Dunham, Clark, Griffin & Moran

[57] ABSTRACT

In the production of aluminum ingots by the direct chill casting process, in which the conventional chilled mold is equipped with a thermally insulated "hot top," smooth surfaced ingots are produced under conditions obtained by correlating of the length of the chilled mold, the casting rate and the head of molten metal in the hot top. Preferably the values of chilled mold length and metalostatic head are selected so as to be tolerant of some variation of metalostatic head which is difficult to avoid in the simultaneous operation of a large number of molds under level pour conditions.

7 Claims, 5 Drawing Figures

EFFECT OF CASTING SPEED AND MOULD LENGTH ON INGOT SURFACE AT 2½IN. PRESSURE HEAD

EFFECT OF MOULD LENGTH AND PRESSURE ON INGOT SURFACE AT DIFFERENT CASTING SPEEDS

HORSEPOWER PER SQ. FT. BARE

METHOD OF DIRECT CHILL CASTING OF ALUMINUM ALLOYS

CROSS-REFERENCE TO RELATED APPLICATION

This application is a continuation-in-part of applicant's copending application Ser. No. 521,371 filed Nov. 6, 1974 for Continuous Casting, now abandoned.

BACKGROUND OF THE INVENTION

The present invention relates to the continuous casting of aluminum (including aluminum alloys), and in particular it relates to continuous casting in so-called "hot top" molds.

In continuous casting practice, molten metal is poured into an open-ended mold, the lower end of which is initially closed by a stool or platform, which is progressively lowered in step with the pouring of the metal. In normal continuous casting practice, the wall of the casting mold is cooled, so that a solid skin of metal forms in contact with the mold wall at the level of the surface of the pool of molten metal in the mold. For practical reasons, it is preferred in the commercial production of ingots to maintain the surface of the molten metal at least 1½ inches (3.8 cms) above the bottom margin of the mold, below which the surface of the emerging ingot is directly cooled by contact with coolant water. Unless that step is adopted there is always a risk of a run-out of molten metal from the bottom of the mold arising from an unexpected fluctuation of the molten metal level. Although it is possible under laboratory conditions to cast with the level of metal lower in the mold with appropriate casting speeds, such operation poses intense difficulties of control with a casting table having 40–60 molds.

It has long been understood that the production of metal ingots in conventional molds, in which the whole surface of the mold wall is chilled, may result in ingots having surface defects. The two commonest forms of surface defect are referred to as "cold shuts," which appear on the ingot in the form of transverse ridges, and "bleeds" or liquation where low melting components of the molten alloy can flow from the pool in the center of the ingot through the interdendritic channels in the shell to the ingot surface in the interval between the formation of the skin at the level of the top surface of the pool and the level at which the peripheral surface of the ingot comes under the chilling influence of the coolant applied to the surface of the ingor below the mold. In this interval, the surface of the skin is subjected to very little cooling since the solid skin contracts away from the mold wall and the transfer of heat from the skin to mold wall is minimal except at or slightly below the meniscus of molten metal at the surface of the pool. It has long been apparent that the "cold shuts" on the surface of the ingot are due to instability of the metal meniscus due to contraction of the molten metal on solidification, related to overcooling of the ingot.

It has already been observed that the coolant applied to the solidified surface of the ingot as it emerges from the mold exerts effective chilling action on the skin for a distance of about 1 inch (2.5 cms) above the level at which it is applied, this distance varying somewhat with change of casting speed. It has been postulated that by employing thermal insulation in the mold so as to hold the metal out of contact with the chilled mold wall until it reached a level at which the skin could be solidified almost solely by the heat withdrawn by means of the sub-mold coolant (coolant applied directly to the surface of the ingot below the mold) smooth-surfaced ingot could be produced. Although smooth-surfaced ingot can be produced in that way, the results are not consistent.

It has been suggested more recently that smooth-surfaced ingots can be produced in hot-top molds by correlating the depth of chilled mold with the dropping rate of the casting. However, this arrangement has also been found to provide inconsistent results, and in practice, when following that teaching, ingots having various forms of surface defect, as well as some smooth-surfaced ingots, have been produced.

In "hot top" mold casting, as presently practiced for the continuous casting of aluminum (including aluminum alloys), a head of molten metal is held in a thermally insulated "hot top" placed over the top of the chilled casting mold and acting as an upward extension of such mold. The "hot top" has a flat bottom end surface and is usually of somewhat less diameter than the chilled mold.

SUMMARY OF THE INVENTION

We have now found that in continuous casting operations of this type, successful and reproducible results can be obtained in producing smooth-surfaced ingot by careful correlation of the mold length, the dropping rate (casting rate) and the metalostatic head of metal contained in the hot top.

The reason for the adoption of "hot top" molds for the production of ingots by the direct chill continuous casting process is normally unconnected with the surface qualities of the produced ingot. In the process as carried out in the conventional manner (without a "hot top"), molten metal from a holding furnace is poured into a sloping delivery trough, from which it passes into the mold through a dip tube, the lower end of which is controlled by a float, to regulate the flow of metal from the trough through the dip tube into the mold. That arrangement leads to some degree of turbulence in the metal, resulting in increase of the formation of oxide and consequent loss of metal cleanliness. More particularly, however, the use of floats and dip tubes entails cost in replacement stores and delays in servicing the molds between successive casting operations. Furthermore, floats may require manual fiddling at the start of the casting operation and may become blocked.

In commercial operation, when casting with a mold equipped with a "hot top" in contradistinction to continuous casting in a conventional mold, the trough opens directly into the hot top and is substantially level, thus eliminating the use of dip tubes and floats and permitting a reduction in the time interval between the pouring of successive ingots. Turbulence and associated oxide generation are also eliminated. It will be seen that the main objective when employing a "hot top" is to achieve greater productivity from the casting machine, coupled with cleaner metal, by elimination of the dip tube and float control. A more or less constant (but necessarily somewhat variable) head of metal is achieved by pouring metal from the holding furnace into a substantially horizontal trough system, from which branches lead to the individual "hot tops," which thus act as reservoirs of molten metal. In operation, the metalostatic head of metal above the mold therefore lies within a range of values primarily dependent on the height at which the trough enters the hot top and to a lesser extent upon the level of metal maintained by the operator in the trough system. In continuous casting operations employing molds equipped with "hot tops" maintenance of an exactly constant head of metal in the "hot top" is not easy to achieve, while the length of chilled mold is a constant in any given operation and the rate of descent of the stool may be controlled to a substantially constant value.

It follows that in an optimum arrangement, the chilled mold length and casting rate (rate of descent of the stool) are so selected that reproducible results are obtained within the expected range of metalostatic head in the "hot top."

The difficulties experienced in earlier operations in which the bare mold length was correlated with casting rate was that the chosen combinations of these conditions were not tolerant of the generally large applied metalostatic heads. As a result, it was necessary to employ any one of a number of special design features at the hot-top/mold juncture to restrict or control heat transfer at that location.

DETAILED DESCRIPTION

Figure 1:
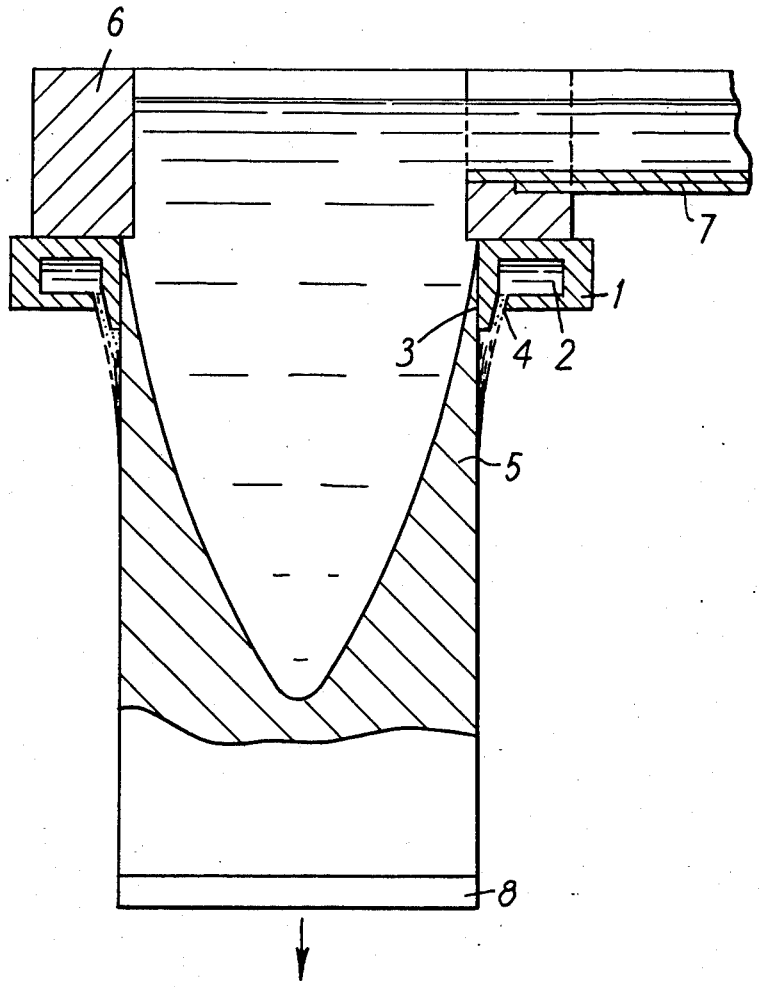
FIG. 1 is a simplified sectional elevational view of casting apparatus in which the process of the present invention may be practiced.

In the accompanying FIG. 1 is illustrated a mold of the type employed in carrying out the procedure of the present invention. The arrangement there shown is frequently referred to as a "level-pour mold." In this arrangement, the metal mold member 1 is provided with a water chamber 2 for chilling the wall 3 and is provided with a water slit 4 through which water is emitted directly onto the surface of the ingot 5 emerging from the mold. A thermally insulating "hot top" or header basin 6 is supported on top of the thermally conductive metal mold member 1 and the molten metal enters the hot top 6 through a trough 7.

The bare mold length is defined by the vertical extent of the mold wall 3 and is unvariable during the casting operation. The casting rate is controlled by the speed at which the stool 8 is moved downwardly. Although this is variable, it is possible to control the speed of the stool descent to quite narrow limits so that the casting rate may be regarded as a preselectable constant. The metalostatic head in the level-pour, hot top 6 is dependent upon the vertical distance between the bottom of the trough 7 and the top of mold 1 plus the depth of metal in trough 7, and it is found that in practical operation of a casting machine equipped with a large number of molds (as is usual in current commercial practice), the operator has difficulty in controlling the equipment to avoid variations of up to about 1 inch in the depth of metal in trough 7 and hot top 6.

In seeking an explanation of the inconsistent results obtained when following earlier teaching for the production of smooth-surfaced ingots by the continuous casting process, we have concluded that surface imperfections could arise in "hot top" molds of the type mentioned above because of the relatively large metalostatic head employed as compared with the head maintained by means of float and dip tube in the conventional manner. In experimental work in which the level of metal within the hot top was maintained substantially constant by means of a float and dip tube (in contrast with commercial practice) and using a chilled bare mold of a length of 1½ inches (3.75 cms), as heretofore proposed for "hot top" casting, we found that tolerably smooth-surfaced ingots could be produced only with pressure heads of 2 inches or less of aluminum in the "hot top" and that the better quality ingots could only be produced at pressure heads of 1 inch or below, which is too low for effective employment of a "hot top" system, as will be appreciated from the foregoing discussion. When a pressure head above 2 inches (5 cms) was employed, it was discovered that "cold shuts" were formed, irrespective of casting speed or other conventionally variable aspects of casting practice. A pressure head of 4 inches (10 cms) is, however, conventional with "hot top" casting, and frequently greater pressure heads are employed.

In the course of further experiments, a constant pressure head of 2½ inches (6.25 cms) was maintained as being about the minimum nominal level which could be employed in a practical level-pour "hot top" casting mold, although in some circumstances it is possible to employ as little as 1½ inches pressure head. In these experiments, chilled molds of various lengths between ¼ inch and 1¾ inches were tested in conjunction with casting speeds varying between 3 inch/min. and 12 inch/min. (between 7.5 cms/min. and 30 cms/min.) and the results were plotted in the accompanying FIG. 2. In this experiment, the coolant water contacted the ingot surface at ⅛–3/16 inches (3–5 mms) below the bottom margin of the mold. It was found that casting under conditions within (to the right of) curve A yielded ingots having tolerable surface defects to permit them to be sold as extrusion ingots, the best surface properties being obtained within the area between line B and the lower margin of curve A.

Figure 3:
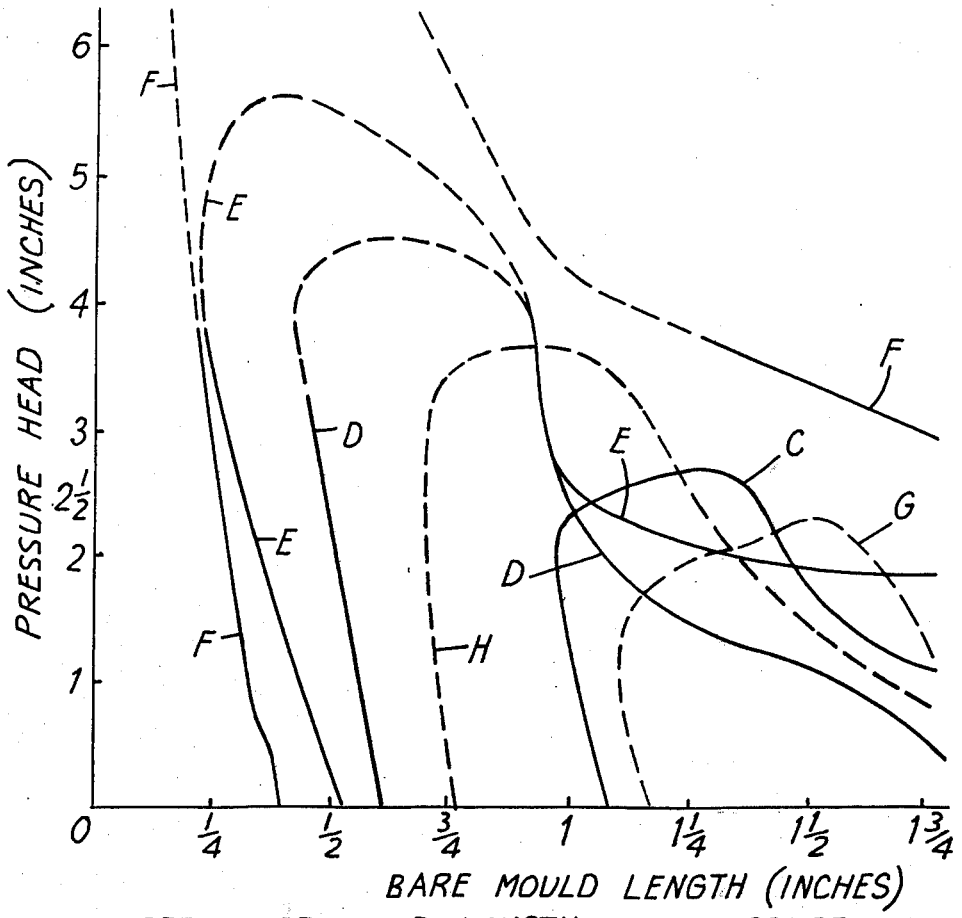
FIG. 3 is a graph of pressure head against bare mold length, defining limits of conditions for the practice of the invention at various specified casting speeds.

In a further series of experiments, the effects of pressure head from ¼ inch to 6 inches were tested in conjunction with chilled molds of different length between ¼ inch and 1¾ inches in relation to casting speeds. The results of these tests are shown in FIG. 3, in which lines C, D, E and F show the limits of conditions within which smooth-surfaced ingots were obtained with casting speeds of 4 inch/min., 6 inch/min., 8 inch/min., and 10 inch/min. respectively. In each case, the ingots with the smoothest surface were obtained with conditions near the left-hand margin of the area enclosed by the curve. Curves G and H, which are partly extrapolated from incomplete data, indicate the conditions of pressure head and chilled mold length for production of smooth ingot at 3½ ins/min. and 5 ins/min. respectively. Because it is very difficult in practice to operate with a pressure head of 2 inches or less in the "hot top," it will be seen that operation at a casting speed of below about 4 inch/min. is generally unsatisfactory and it is preferred to employ higher casting speeds. It is believed that with appropriate adjustment of the length of the chilled mold, smooth-surfaced ingot can be obtained with casting speeds up to inch/min. and with pressure heads in the range of 2½ - 4 inches.

These curves were obtained with circular bare molds of 6-inch diameter with an aluminum alloy containing 0.18% Fe, 0.50% Mg and 0.44% Si, a standard magnesium silicide alloy for the production of extrusions.

In experiments carried out with the same alloy in molds of 4.4-inch diameter, it was found that smooth-surfaced ingot was obtained at a speed of 9 inch/min. with a bare mold length of ⅜-½ inch with pressure heads in the range of 4–6 inches, which is in close agreement with curves E and F.

Similar curves obtained with other alloys show some small variations from those obtained with the above-mentioned alloy and shown in FIG. 3. Such variations appear to be due to variations in thermal conductivity of the alloy at the transition from liquid to solid. Higher conductivity of the metal leads to a requirement for a greater length of bare mold.

The curves shown in FIG. 3 enable it to be predicted that when employing a casting speed of 5½ inch/min. in conjunction with a pressure head in the range of 2½ - 4 inches, as typically employed in "hot top" mold casting, smooth-surfaced ingots will be obtained at this speed with chilled mold lengths of the order of ⅞ inch. Practical test at 5 inches per min. shows that smiith-surfaced ingots are obtained with chilled mold lengths of ¾ inch and ⅞ inch, but that cold shuts are experienced when the mold length is only ⅝ inch.

From curve F, it could be predicted that an ingot with acceptably smooth surface could be cast at higher casting speed under "hot top" mold pressure head conditions employing a chilled mold length of the order of 1 inch. This was confirmed by casting an ingot at 11 inch/min. in a mold having a chilled length of ¾ inch and a pressure head of 2½ - 4 inches. In the producton of ingots by means of a casting apparatus equipped with level-pour hot top molds, it is well within the limitations of operator skill to hold the pressure head within this range.

Consideration of FIG. 3 and the above additional experimental data shows that smooth-surfaced ingots may be produced at casting rates of 5½ inch/min. and upwards, when employing molds having a chilled length in the range of ¾-⅞ (19–22 mms) and pressure head conditions typical of "hot top" mold casting, while acceptably smooth-surfaced ingots may be produced at casting rates of 6 inch/min. and upwards when employing molds having a chilled length in the range of ½-⅞ inch (18–22 mms) under the same pressure head conditions.

From the curves shown in FIG. 3, a solid model may be built up from which may be predicted the combinations of pressure head, chilled mold length and casting rate at which smiith-surfaced ingot may be obtained. Consideration of curves C and D shows that as the casting speed is increased in the range of 4 ins/min. to 6 ins/min., the maximum tolerable pressure head rapidly increases. As will be seen, at 4 ins/min. the maximum permissible pressure head for attainment of smooth-surfaced ingot is about 2½ inches. At 3½ inches/min. casting rate, it is possible to obtain smooth-surfaced ingot at a maximum pressure hed of about 2 inches pressure head and appropriate bare mold length. The maximum pressure head for smooth-surfaced ingot increases to about 4 inches at 5½ ins/min. Consequently, where it is necessary to restrict the casting rate to prevent center cracking, the maximum permissible casting rate should be employed and the bare mold and pressure head selected from consideration of the solid model obtainable from curves of FIG. 3.

However, it will be seen that when equipping a casting table for "hot top" mold casting, it will most preferably be equipped with molds having a chilled length of ¾-⅞ inch (19–22 mms) length, since this permits the greatest variation of casting speed through the range of 5–12 inch/min. when such casting speeds are acceptable. If a lower limit of casting speed of 6 inch-min. is acceptable, it might be preferred to equip the table with molds having a chilled length as low as ½ inch (13 mms), since such molds will produce rather smoother surfaces at the higher casting speeds.

From these curves, it can be seen that pressure heads up to 6 inches could be employed with mold lengths in the ½-¾ inch range if the casting speed is at 6 inch/min. or somewhat above (up to 10 ins/min.).

The mechanism of the process is believed to reside in balancing the downward metalostatic pressure which presses the metal out against the wall of the mold at the junction of the "hot top" and the chilled mold with the contracting force exerted by the sub-mold coolant so as to maintain stability of the metal meniscus.

We have found that when following the principles of the present invention, a quite wide variation in the overhang of the "hot top" in relation to the mold is permissible without having any substantial effect on the surface of the produced ingot. Thus we have found that an overhang in the range of ⅛-2 inches is permissible. We also find that a gap of up to 0.01 inch between the chilled mold and "hot top" is permissible.

It is one of the particular advantages of the present invention that it permits smooth-surfaced ingots to be produced solely by selection of appropriate casting speeds and chilled mold lengths for use with pressure heads in the range which are practicable for level-pour "hot top" casting. It renders it unnecessary to employ special ancillary equipment for control of meniscus stability.

In order not to upset the balance between the effects of metalostatic head and sub-mold cooling, it is highly desirable to avoid any "bumping" of the ingot by reason of vaporization of water between the stool and the butt end of the ingot, particularly when the butt end of the ingot first emerges from the mold. It is well known that the butt end of an ingot, cast on a flat table, becomes somewhat bowed (convex) as a result of the removal of heat by the sub-mold coolant. As a feature of the present invention, a stool having a somewhat raised central area is employed to reduce the possibility of entrapment of sub-mold coolant water between the butt end of the ingot and the stool.

In conjunction with the casting of 6-inch diameter ingots, it has been found satisfactory to elevate the central 3 inches of the stool by ¼ inch in relation to the periphery.

Although it has utility in the production of ingots intended for other purposes, the procedure of the present invention is primarily concerned with the production of round extrusion ingots in the range of 3 in.–9 in. diameter. Aluminum extrusion ingots are commonly cast in aluminum magnesium silicide alloys of the type already mentioned in connection with the experiments recorded in FIGS. 2 and 3.

Figure 5:
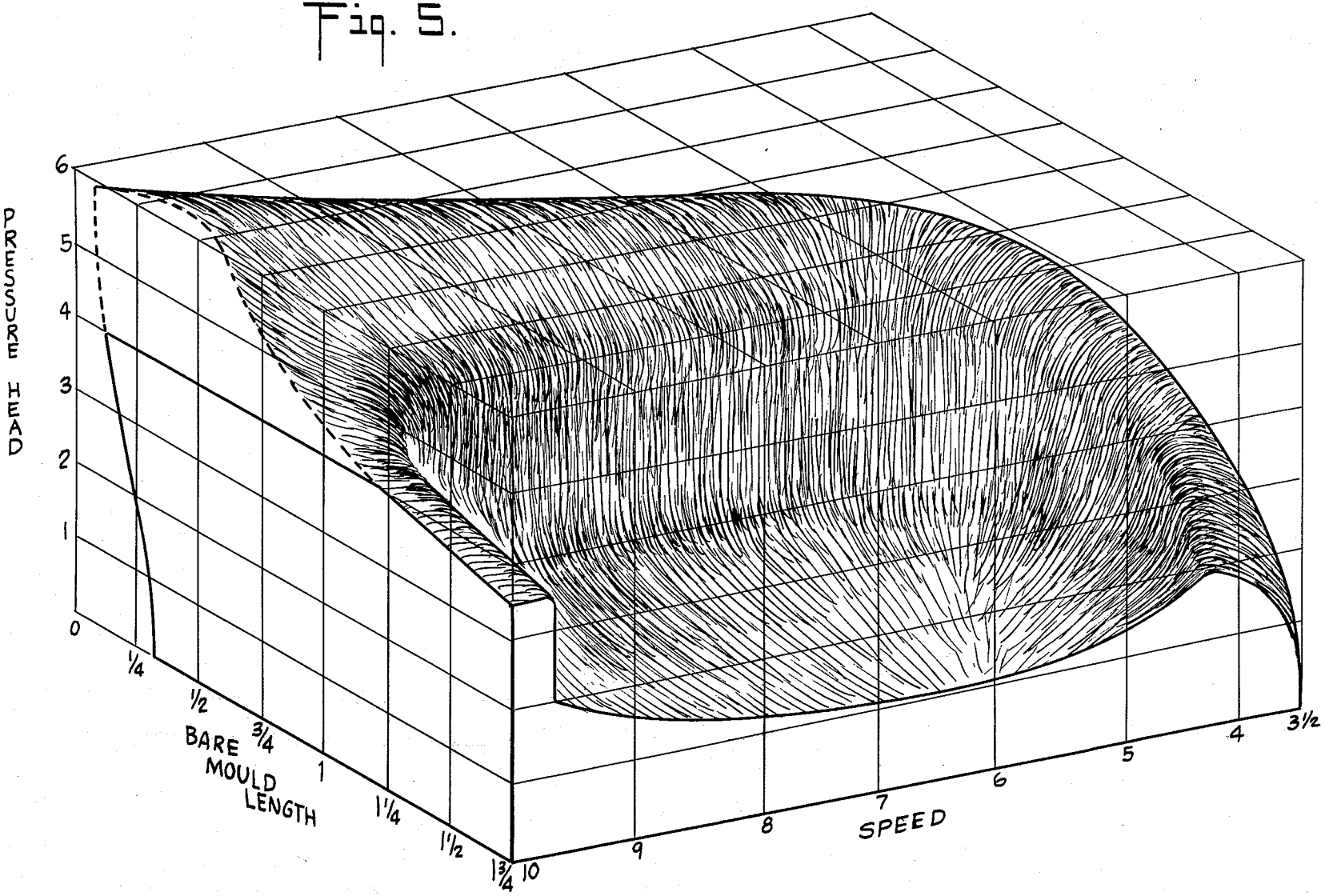
FIG. 5 is a perspective view of a three-dimensional plot of casting speed vs. bare mold length vs. pressure head, illustrating the envelope defining satisfactory combinations of these three conditions for the practice of the present invention.

The solid model referred to above is illustrated in perspective in FIG. 5, which is a three-dimensional graphical representation of the limiting values of combinations of pressure head, bare mold length and casting rate at which acceptably smooth-surfaced ingot may be obtained in accordance with the invention. Thus, within the outer limiting values of bare mold length (¼ to 1¾ inches), casting rate (3½ to 16 in./min.), and pressure head (at least 1½ inches, preferably not more than 6 inches), the process of the invention contemplates casting with combinations of values of those three factors which lie wholly within the limiting three-dimensional envelope represented in FIG. 5 (or within the extrapolations of that envelope to the left, as seen in FIG. 5, for values of casting rate ranging upwardly of 10 in./min.).

It will be seen that the three axes of the FIG. 5 graph respectively represent pressure head, bare mold length, and casting rate. The curve of FIG. 3 are in effect projections, on the plane defined by the mold length and pressure head axes, of sections through the FIG. 5 envelope (taken parallel to the last-mentioned plane) at points corresponding to various casting speed, viz.:

| FIG. 3 curve | Casting speed (in./min.) |
|---|---|
| G | 3½ |
| C | 4 |
| H | 5 |
| D | 6 |
| E | 8 |
| F | 10 |

Figure 4:
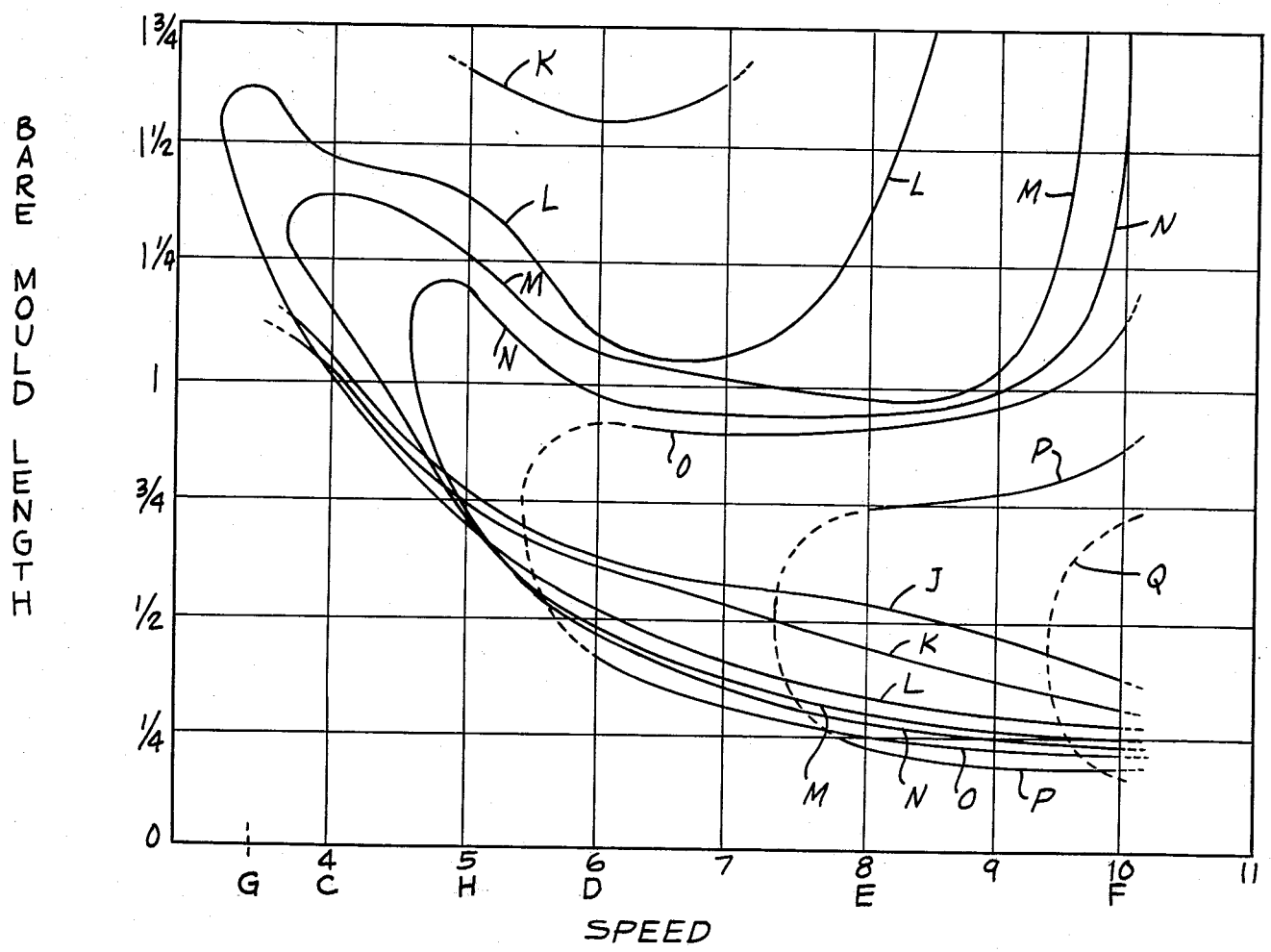
FIG. 4 is a graph of bare mold length against casting speed, defining limits of conditions for the practice of the invention at various pressure heads.

Similarly, FIG. 4 is a graph of bare mold length against casting rate, whereon the curves represent limiting values of mold length and casting rate at various pressure heads in accordance with the invention, viz.:

| FIG. 4 curve | pressure head (inches) |
|---|---|
| J | 0 |
| K | 1 |
| L | 2 |
| M | 2½ |
| N | 3 |
| O | 4 |
| P | 5 |
| Q | 6 |

These curves, again, are in effect projections, on the plane of the mold length-casting rate axes in FIG. 5, of sections through the FIG. 5 envelope (parallel to the latter plane) at points corresponding to the above-specified pressure heads.

Accordingly, the ranges or limits of combinations of values of any two of the three factors of bare mold length, casting rate and pressure head may be determined, for any given value of the third factor, i.e. within the absolute outer range set forth above, by interpolation or extrapolation from the sets of curves respectively shown in FIGS. 3 and 4, which together define the solid or three-dimensional limiting envelope of FIG. 5.

It is to be understood that the invention is not limited to the features and embodiments hereinabove specifically set forth, but may be carried out in other ways without departure from its spirit.

I claim:

1. In a process for the production of smooth-surfaced aluminum ingots by the direct chill continuous casting process comprising the steps of a. pouring molten metal into an open-ended thermally insulated "hot top" section having a flat bottom surface;

b. allowing the molten metal to descend from said hot top section into a lower chilled mold section axially aligned with said hot top section and bringing said molten metal into contact with said chilled mold section to produce a solidified peripheral layer;

c. withdrawing the metal continuously from the chilled mold section at a predetermined casting rate and applying coolant directly to the surface of the solidified peripheral layer of metal emerging from the chilled mold section, the improvement which comprises d. performing steps (b) and (c) with a chilled mold section having a selected vertical extent within a range of values between ½ and ¾ inch, and e. maintaining said casting rate at a selected value within a range between 6 and 10 inches per minute, f. maintaining, in the hot top section, a head of molten metal within a range of head values of 2½ – 4 inches according to the values selected in steps (d) and (e).

2. In a process for the production of smooth-surfaced aluminum ingots by the direct chill continuous casting process comprising the steps of a. pouring molten metal into an open-ended thermally insulated "hot top" section having a flat bottom surface;

b. allowing the molten metal to descend from said hot top section into a lower chilled mold section axially aligned with said hot top section and bringing said molten metal into contact with said chilled mold section to produce a solidified peripheral layer;

c. withdrawing the metal continuously from the chilled mold section at a predetermined casting rate and applying coolant directly to the surface of the solidified peripheral layer of the metal emerging from the chilled mold section;

the improvement which comprises selecting a casting rate in the range of 3½ – 12 inches/minute, employing a selected bare mold length below 1.75 inches, and maintaining a pressure head of molten metal in the hot top section at a selected value of at least 1½ inches, the values of the casting rate, bare mold section length and pressure head of molten metal also being selected so that their coordinates fall within a solid model constructed in accordance with the curves of FIGS. 3 and 4.

3. A process according to claim 2 in which the bare mold section has an internal diameter in the range of 3 – 9 inches.

4. A process according to claim 3 in which the molten metal is an aluminum magnesium silicide alloy.

5. A process according to claim 2 wherein said range of head values extends over at least 1 inch.

Figure 2:
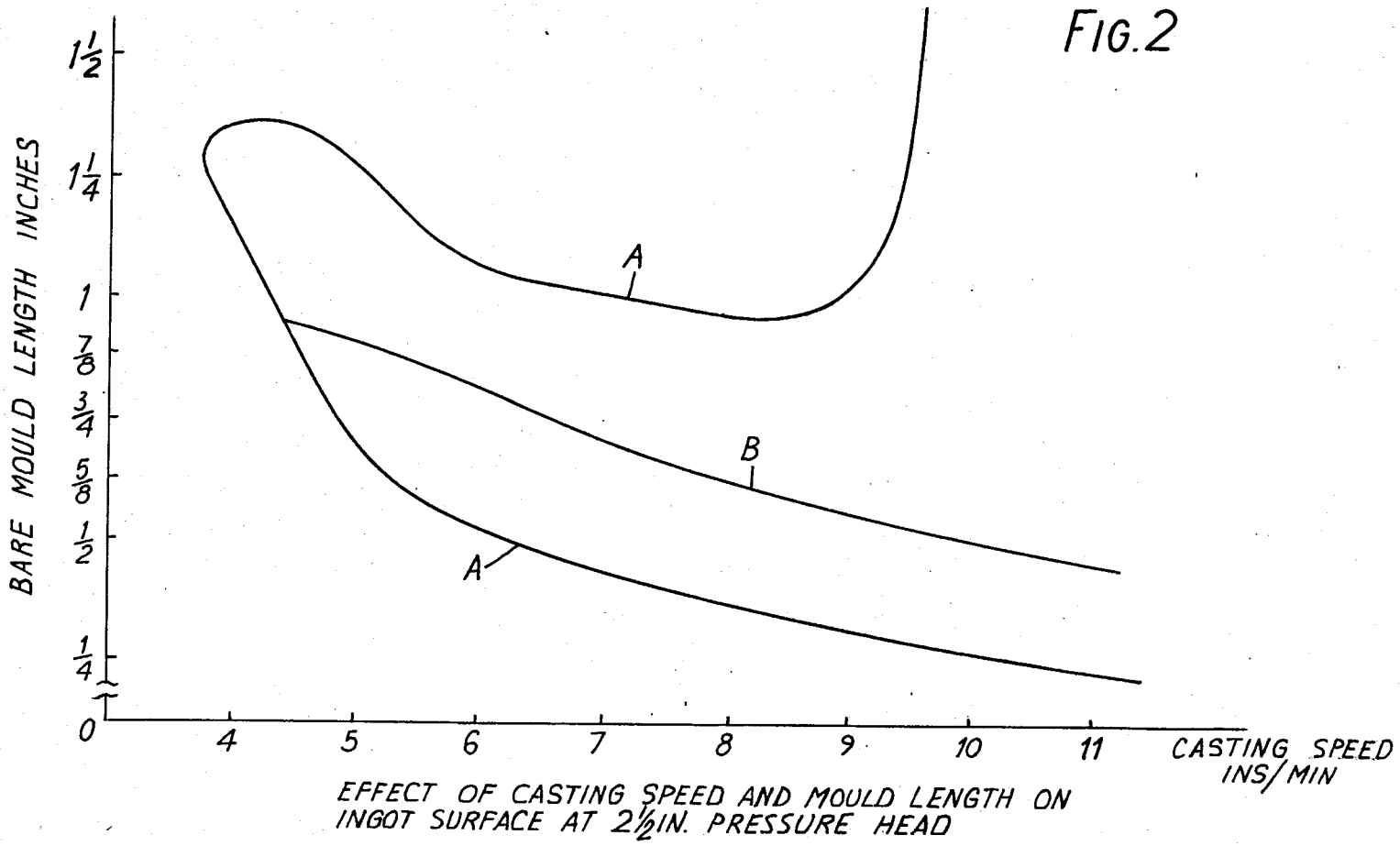
FIG. 2 is a graph on which values of bare mold length are plotted against casting speed, for a pressure head of 2½ inches, to illustrate limits of satisfactory and preferred values for the practice of the present process at that pressure head.

6. In a process for the production of smooth-surfaced aluminum ingots by the direct chill continuous casting process comprising the steps of a. pouring molten metal into an open-ended thermally insulated "hot top" section having a flat bottom surface;

b. allowing the molten metal to descend from said hot top section into a lower chilled mold section axially aligned with said hot top section and bringing said molten metal into contact with said chilled mold section to produce a solidified peripheral layer;

c. withdrawing the metal continuously from the chilled mold section at a predetermined casting rate and applying coolant directly to the surface of the solidified peripheral layer of the metal emerging from the chilled mold section, the improvement which comprises d. performing steps (b) and (c) with a chilled mold section having a selected vertical extent with a range of values between ¼ and 1 inch, and e. maintaining said casting rate at a selected value within range between 5½ and 16 inches per minute, f. said vertical extent and said casting rate being selected to have coordinates lying to the right of curve A in FIG. 2; and g. maintaining, in the "hot top" section, a head of molten metal within a range of 2½ – 4 inches according to the values selected in step (f).

7. In a process for the production of smooth-surfaced aluminum ingots by the direct chill continuous casting process comprising the steps of a. pouring molten metal into an open-ended thermally insulated "hot top" section having a flat bottom surface;

b. allowing the molten metal to descend from said hot top section into a lower chilled mold section axially aligned with said hot top section and brinding said molten metal into contact with said chilled mold section to produce a solidified peripheral layer;

c. withdrawing the metal continuously from the chilled mold section at a predetermined casting rate and applying coolant directly to the surface of the solidified peripheral layer of the metal emerging from the chilled mold section, the improvement which comprises d. performing steps (b) and (c) with a chilled mold section having a selected vertical extent within a range of values between ¼ and ⅞ inches, and e. maintaining said casting rate at a selected value within a range between 5½ and 16 inches per minute, f. said vertical extent and said casting rate being selected to have coordinates lying to the right of curve A, but beneath curve B, in FIG. 2; and g. maintaining in the hot top section a head of molten metal within the range of 2½ – 4 inches according to the values selected in step (f).

* * * * *